US006905385B2

(12) United States Patent
Speer et al.

(10) Patent No.: US 6,905,385 B2
(45) Date of Patent: Jun. 14, 2005

(54) METHOD FOR INTRODUCING MERCURY INTO A FLUORESCENT LAMP DURING MANUFACTURE AND A MERCURY CARRIER BODY FACILITATING SUCH METHOD

(75) Inventors: Richard S. Speer, Concord, MA (US); Louise D. Cleary, Salem, MA (US); Joseph V. Lima, Salem, MA (US)

(73) Assignee: Osram Sylvania, Inc., Danvers, MA (US)

( * ) Notice: Subject to any disclaimer, the term of this patent is extended or adjusted under 35 U.S.C. 154(b) by 105 days.

(21) Appl. No.: 10/308,943

(22) Filed: Dec. 3, 2002

(65) Prior Publication Data

US 2004/0104665 A1 Jun. 3, 2004

(51) Int. Cl.[7] ..... H01J 9/38

(52) U.S. Cl. ..... 445/53; 445/9; 445/42; 445/43; 445/56; 445/58; 313/313; 313/550; 313/565

(58) Field of Search ..... 313/550, 565, 313/490, 571, 639, 552, 564, 566; 315/248, 57; 445/38, 42, 43, 53, 56, 58, 9

(56) References Cited

U.S. PATENT DOCUMENTS

| | | | | | |
|---|---|---|---|---|---|
| 4,035,682 | A | | 7/1977 | Bubar | 313/174 |
| 4,393,325 | A | | 7/1983 | van der Kooi | 313/552 |
| 4,528,209 | A | | 7/1985 | Anderson et al. | 427/67 |
| 5,434,482 | A | | 7/1995 | Borowiec et al. | 315/248 |
| 5,629,584 | A | | 5/1997 | Borowiec et al. | 313/565 |
| 5,757,129 | A | * | 5/1998 | Schafnitzel et al. | 445/9 |
| 5,767,617 | A | | 6/1998 | Wharmby et al. | 313/489 |
| 5,994,837 | A | | 11/1999 | Willems et al. | 313/550 |
| 6,097,137 | A | | 8/2000 | Forsdyke et al. | 313/161 |
| 6,650,041 | B1 | * | 11/2003 | Speer et al. | 313/490 |

* cited by examiner

*Primary Examiner*—Nimeshkumar D. Patel
*Assistant Examiner*—Sharlene Leurig
(74) *Attorney, Agent, or Firm*—Carlo S. Bessone

(57) ABSTRACT

Method for introducing a limited amount of mercury into a fluorescent lamp during manufacture thereof includes the steps of forming the lamp with an exhaust tubulation therein open at an end thereof and provided with a ball retention structure, exhausting the interior of the lamp through the tubulation open end, placing a rigid ball of inert material in the tubulation between the ball retention structure and the tubulation open end, the ball having a coating of a selected one of silver, gold, and indium, of a selected mass over a selected surface area of the ball, and mercury on the coated area, and sealing the open end of the tubulation, whereby the amount of mercury retained on the ball and thereby introduced into the lamp is limited by the selected mass of the coating on the ball.

17 Claims, 1 Drawing Sheet

METHOD FOR INTRODUCING MERCURY INTO A FLUORESCENT LAMP DURING MANUFACTURE AND A MERCURY CARRIER BODY FACILITATING SUCH METHOD

BACKGROUND OF THE INVENTION

1. Field of the Invention

This invention relates to the manufacture of fluorescent lamps and is directed more particularly to the introduction of a limited amount of mercury into the lamp by way of a lamp exhaust tubulation. The invention further relates to a carrier body for placement in the lamp and which carries thereon a selected amount of mercury to be admitted to the lamp.

2. Description of the Prior Art

Fluorescent lamps typically include at least one tubulation which provides a conduit extending into the interior of the lamp envelope and which, in construction of the lamp, is used as an exhaust tubulation. At completion of manufacture, the exhaust tubulation is hermetically closed.

Before sealing off of the exhaust tubulation open end, a measured amount of mercury is introduced into the lamp. One of the challenges facing lamp manufacturers is to minimize the amount of mercury put into the lamp. It has been found difficult to regulate the introduction of small amounts, such as three milligrams or less, of mercury.

There is thus a need for a method for introducing small amounts of mercury into a fluorescent lamp. There is further a need for a device which is structured to facilitate the introduction of limited amounts of mercury and which is easily handled in lamp manufacturing procedures.

SUMMARY OF THE INVENTION

An object of the invention is, therefore, to provide a method for introducing a limited amount of mercury into an envelope of a fluorescent lamp during manufacture of the lamp.

A further object of the invention is to provide a body for placement in the lamp during manufacture, which body is adapted to receive and retain only a selected amount of mercury and serve as a carrier for the mercury introduced into the lamp.

With the above and other objects in view, a feature of the present invention is the provision of a method for introducing a limited amount of mercury into an envelope of a fluorescent lamp during manufacture of the lamp. The method includes the steps of forming the fluorescent lamp with an exhaust tubulation therein, the exhaust tubulation being open at an end thereof and being provided with a ball retention structure proximate the open end, exhausting the interior of the lamp envelope through the exhaust tubulation open end, and placing a rigid ball of inert material in the exhaust tubulation between the ball retention structure and the exhaust tubulation open end. The ball is provided with a coating of a metal comprising a selected one of silver, gold, and indium, and alloys thereof, of a selected mass over a selected surface area of the ball, and with mercury on the coated area of the ball, such that a limited and selected amount of the mercury is retained on the ball by the coating metal. The amount of mercury retained on the ball is limited by the selected mass of the coating on the ball. The method further comprises sealing the open end of the exhaust tubulation.

In accordance with a further feature of the invention, there is provided a method for introducing a limited amount of mercury into an envelope of a fluorescent lamp during manufacture of the lamp. The method includes the steps of forming the fluorescent lamp with an exhaust tubulation therein, the exhaust tubulation being open at an end thereof, exhausting the interior of the lamp envelope through the exhaust tubulation open end, and placing a rigid ball of inert material in the lamp by way of the exhaust tubulation open end. The ball is provided with a coating of a metal comprising a selected one of silver, gold, and indium, and alloys thereof, of a selected mass, over a selected surface area of the ball, and with mercury on the coated area of the ball, such that a limited and selected amount of the mercury is retained on the ball by the coating metal, and sealing the open end of the exhaust tube. The amount of mercury retained on the ball is limited by the selected mass of the coating on ball.

In accordance with a still further feature of the invention, there is provided a carrier body for placement in a fluorescent lamp during manufacture of the lamp. The body comprises a sphere of rigid inert material, a coating of a metal comprising a selected one of silver, gold, and indium, and alloys thereof, of a selected mass, disposed over a selected surface area of the sphere, and mercury disposed on the metal coating and retained thereby in an amount up to that permitted by the selected mass of the metal coating. The body thus carries into the lamp a selected amount of mercury and is adapted for retention in the lamp after sealing of the lamp at completion of manufacture.

The above and other features of the invention, including various novel details of construction and combinations of parts and method steps, will now be more particularly described with reference to the accompanying drawings and pointed out in the claims. It will be understood that the particular methods and device embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
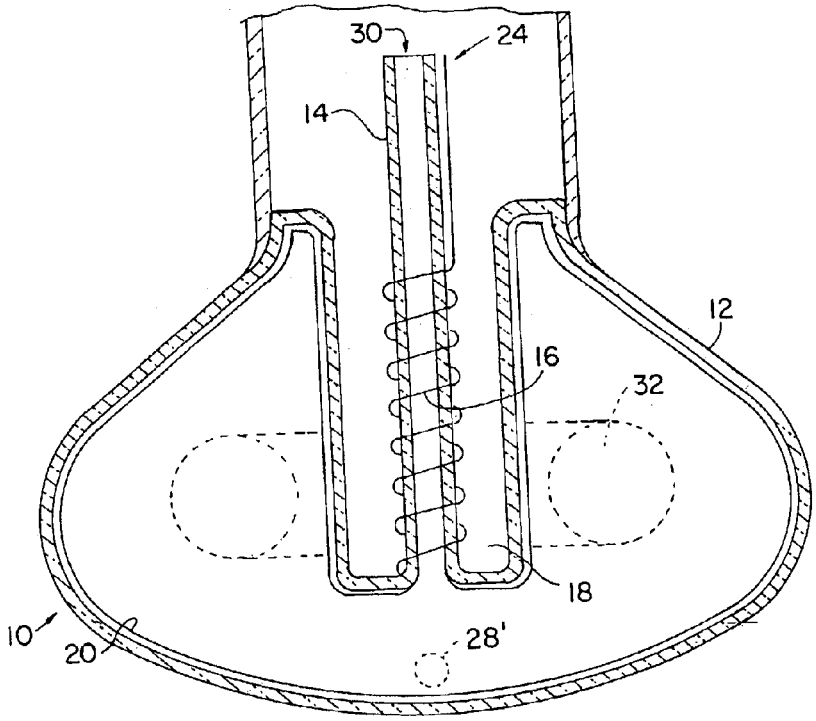
FIG. 1 is a diagrammatic sectional view of one type of fluorescent lamp during manufacture thereof, and illustrative of embodiments of the invention.

Referring to FIG. 1, it will be seen that a known compact fluorescent lamp 10 is provided with a light-transmissive envelope 12 containing an ionizable gaseous fill for sustaining an arc discharge. In manufacture, the lamp 10 is dosed with the fill via an exhaust tubulation 14 in a known manner. A suitable fill, for example, comprises a mixture of a rare gas (e.g., krypton and/or argon) and mercury vapor. An excitation coil 16 is situated within, and removable from, a re-entrant cavity 18 within the envelope 12. For purposes of illustration, the coil 16 is shown schematically as being wound about the exhaust tubulation 14. However, the coil 16 may be spaced apart from the exhaust tubulation 14 and wound about a core of insulating material (not shown), or may be free standing (not shown), as desired. The interior surfaces of the envelope 12 are coated in well-known manner with a suitable phosphor 20. In the illustrated type of lamp, the envelope 12 fits into one end of a base assembly (not shown) containing a radio frequency power supply with a standard Edison type lamp base.

Figure 2:
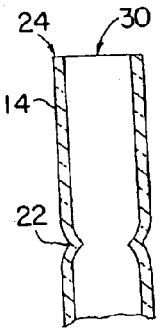
FIG. 2 is a sectional view of an exhaust tubulation portion of the lamp of FIG. 1, the tubulation portion being shown with a pinched portion for retention of a spherical body.
Figure 3:
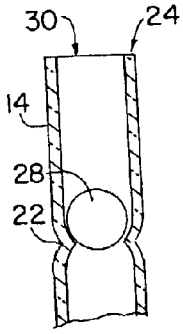
FIG. 3 is similar to FIG. 2, but further includes a mercury carrier in the form of a spherical body resting on the pinched portion.

An indentation, or pinched portion 22 (FIG. 2), is disposed proximate a tip-off region 24 of the exhaust tubulation 14. The tip-off region 24 is the area at the free end of the exhaust tubulation 14 which is sealed, or "tipped off" to form the closed end 26 (FIG. 4) of the exhaust tubulation after evacuating the lamp therethrough.

After the lamp is evacuated through the exhaust tubulation 14, an appropriately sized and shaped glass ball 28 is inserted into the exhaust tubulation 14 through an opening 30 at the tip-off region 24. By virtue of the presence of the pinched portion 22 and the size and shape of the ball 28, the ball remains on the side of the pinched portion 22 away from re-entrant cavity 18. Finally, as noted above, the exhaust tubulation 14 is tipped-off at a location proximate the ball 28 to form the tubulation closed end 26.

In operation, current flows in the coil 16 as a result of excitation by the aforementioned radio frequency power supply. A radio frequency magnetic field is thereby established within the envelope 12 which ionizes and excites the gaseous fill contained therein, resulting in a toroidal discharge 32 (FIG. 1) and emitting ultraviolet radiation therefrom. The phosphor 20 absorbs the ultraviolet radiation and emits visible radiation.

Figure 4:
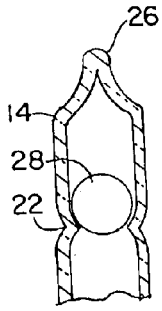
FIG. 4 is similar to FIG. 3, but shows an end of the tubulation closed off.

Referring to FIG. 4, it will be seen that in accordance with the present invention there is provided the ball 28 disposed in the glass tubulation 14 and retained by the pinched portion 22 of the tubulation. In accordance with the invention, the ball 28 serves as a mercury carrier.

Figure 5:
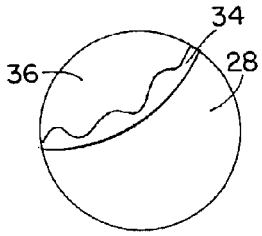
FIG. 5 is an enlarged side elevational view of one form of mercury carrier illustrative of an embodiment of the invention.

Referring to FIG. 5, it will be seen that the ball 28 comprises a sphere of a rigid inert material, usually glass. A coating 34 of a metal is disposed on the ball 28. The metal is a selected one of silver, gold and indium, and alloys thereof. The mass of the coating metal determines the amount of mercury which will be retained thereby. Once the required mass is computed and the desired thickness of the coating is determined, the surface area of the ball which is to be covered will have been determined. The surface area may comprise the whole of the surface area of the ball, or any portion less than the whole of the ball, the latter being illustrated in FIG. 5. If the selected surface area is less than the whole, it is preferable that the coating be disposed in a single patch on the surface of the ball.

Mercury 36 is applied to the metal coating 34. The metal coating 34, by virtue of the selected mass thereof, is operative to retain a predetermined amount of the mercury. In practice, amounts of mercury up to three milligrams are readily obtainable on a typical fluorescent lamp glass ball. A dose of about two milligrams is commonly selected and easily supported by the metal coating. The ball 28, with the coating 34 and mercury 36 thereon, is placed in the exhaust tubulation 14 and the open end of the tubulation is sealed, as at 26 (FIG. 4).

The ball 28 thus serves to accurately limit dosing of the lamp with very small amounts of mercury, from about 3 milligrams to well under 1 milligram.

The ball 28 may be used in conjunction with one or more additional glass balls for supporting an amalgam and/or for spacing the ball 28 and/or amalgam balls in the exhaust tubulation.

The ball 28 need not necessarily be disposed in the exhaust tubulation 14. Rather, the ball 28 may be fed into the lamp envelope 12 through the exhaust tubulation 14. In this embodiment, the tubulation is not provided with the pinched portion 22 prior to introduction of the ball, and the ball 28 enters the envelope and resides therein, as at 28' in FIG. 1. The open end of the exhaust tubulation is thereafter pinched, if amalgam balls are to be used, and thereafter closed.

There are thus provided methods for introducing a selected and limited amount of mercury into an envelope of a fluorescent lamp during manufacture of the lamp. There is further provided a mercury carrier body in the form of a ball for placement in the lamp during manufacture, and which is adapted to retain only the selected amount of mercury for dosing the lamp.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A method for introducing a limited amount of liquid mercury into an envelope of fluorescent lamp during manufacture of the lamp, the method comprising the steps of:

forming the fluorescent lamp with an exhaust tubulation therein, the exhaust tubulation being open at an end thereof and being provided with a ball retention structure proximate the open end;

exhausting the interior of the lamp envelope through the exhaust tubulation open end;

placing a rigid ball of inert material in the exhaust tubulation between the ball retention structure and the exhaust tubulation open end, the ball having a coating of a metal comprising a selected one of silver, gold, and indium, and alloys thereof, of a selected mass over a selected surface area of the ball, and having mercury on the coated area of the ball, such that a limited amount of the mercury is retained by the metal coating; and sealing the open end of the exhaust tubulation;

whereby the amount of mercury retained on the ball and thereby introduced into the lamp is limited by the selected mass of the metal coating on the ball.

2. The method in accordance with claim 1 wherein the selected surface comprises a whole of the surface of the ball.

3. The method in accordance with claim 1 wherein the selected surface comprises less than a whole of the surface of the ball.

4. The method in accordance with claim 1 wherein the coating is a selected one of silver and silver alloy.

5. The method in accordance with claim 1 wherein the amount of mercury retained on the ball comprises up to about 3 milligrams.

6. The method in accordance with claim 5 wherein the retained amount of mercury comprises about 2 milligrams.

7. The method in accordance with claim 1 wherein the selected surface area comprises a single patch of the surface area.

8. A method for introducing a limited amount of liquid mercury into an envelope of a fluorescent lamp during manufacture of the lamp, the method comprising the steps of:

forming the fluorescent lamp with an exhaust tubulation therein, the exhaust tubulation being open at an end thereof;

exhausting the interior of the lamp envelope through the exhaust tubulation open end;

placing a rigid body of inert material in the lamp by way of the exhaust tabulation open end, the body having a coating of a metal comprising a selected one of silver, gold, and indium, and respective alloys thereof, of a selected mass, over a selected surface area of the body, and having mercury on the coated area of the body, such that a limited amount of the mercury is retained on the body by the metal coating; and sealing the open end of the exhaust tubulation;

whereby the amount of mercury retained on the body and thereby introduced into the lamp is limited by the selected mass of the metal coating on the body.

9. The method in accordance with claim 8 wherein the coating is a selected one of silver and silver alloy.

10. The method in accordance with claim 8 wherein the amount of mercury retained on the body comprises up to about 3 milligrams.

11. A body for placement in a fluorescent lamp during manufacture of the lamp, the body comprising:

a sphere of rigid inert material;

a coating of a metal comprising a selected one of silver, gold, and indium, and alloys thereof, of a selected mass disposed over a whole surface area of said sphere; and mercury disposed on said metal coating and retained thereby in an amount up to that permitted by the selected mass of said metal coating;

said body being adapted for retention in the lamp after sealing of the lamp at completion of manufacture, and for introducing the permitted amount of mercury into the lamp.

12. The body in accordance with claim 11 wherein the rigid inert material is glass.

13. The body in accordance with claim 11 wherein said coating is a selected one of silver and silver alloy.

14. The body in accordance with claim 11 wherein the amount of mercury retained thereby comprises up to about 3 milligrams.

15. The body in accordance with claim 14 wherein the amount of mercury retained thereby comprises about 2 milligrams.

16. The body in accordance with claim 11 wherein said sphere is adapted for placement in, and retention in, an exhaust tubulation disposed in the lamp and sealed at completion of manufacture of the lamp.

17. The body in accordance with claim 16 wherein said sphere is adapted for retention in the exhaust tubulation proximate a closed end of the exhaust tubulation.

* * * * *